United States Patent [19]

Ushitora et al.

[11] Patent Number: 5,074,718

[45] Date of Patent: Dec. 24, 1991

[54] VACUUM-TYPE SEWAGE COLLECTING APPARATUS

[75] Inventors: Akihiro Ushitora, Kanagawa; Kazuo Yamaguchi, Tokyo; Tsuneo Asanagi, Kanagawa, all of Japan

[73] Assignee: Ebara Corporation, Tokyo, Japan

[21] Appl. No.: 574,198

[22] Filed: Aug. 29, 1990

[30] Foreign Application Priority Data

Aug. 31, 1989 [JP] Japan ..... 1-225836

[51] Int. Cl.[5] ..... B65G 53/24

[52] U.S. Cl. ..... 406/151; 406/191; 137/236.1; 4/321

[58] Field of Search ..... 406/120, 151, 191; 137/205, 236.1; 4/316, 321, 323, 431

[56] References Cited

U.S. PATENT DOCUMENTS 4,171,853 10/1979 Cleaver et al. ..... 406/48

*Primary Examiner*—Johnny D. Cherry
*Assistant Examiner*—Andrew C. Pike
*Attorney, Agent, or Firm*—Wenderoth, Lind & Ponack

[57] ABSTRACT

A vacuum-type sewage collecting apparatus is arranged in such a manner that sewage discharged from the houses or facilities is once accumulated in a cesspool, and the sewage accumulated in the cesspool is then collected through a vacuum valve and a vacuum sewage pipe, the interior of which is under a negative pressure. The vacuum valve is operated by negative pressure taken from a vacuum source and supplied to the vacuum valve via a connecting pipe. The negative pressure for operating the vacuum valve is taken from a portion of a vacuum sewage pipe which is elevated at a level higher than that of the vacuum valve and is disposed downstream of the vacuum valve. Alternatively, the negative pressure may be directly taken from an accumulating tank, the inner pressure of which has been evacuated by a vacuum pump, from a pipe which establishes a connection between the accumulating tank and the vacuum pump, or from a tank connected to the pipe connecting the accumulating tank and the vacuum pump. In this way, a high negative pressure can be supplied to the vacuum valve to effectively and completely open the vacuum valve to thereby perform an efficient discharge of the sewage through the same valve.

8 Claims, 4 Drawing Sheets

VACUUM-TYPE SEWAGE COLLECTING APPARATUS

BACKGROUND OF THE INVENTION

1. Field of the Art

The present invention relates to a vacuum-type sewage collecting apparatus for collecting sewage from a plurality of houses or facilities. More particularly, the present invention relates to a vacuum-type sewage collecting apparatus wherein a structure for use in operating a vacuum valve is improved.

2. Prior Art

Hitherto, a vacuum-type sewage collecting apparatus for collecting sewage from a plurality of houses or facilities has been known.

FIG. 3 illustrates the overall structure of a vacuum-type sewage collecting apparatus of the type described above.

As shown in the drawing, sewage discharged from each house 30 on the ground passes through sewage pipes 5 disposed underground and is discharged into cesspools 4 disposed more deeply underground. When a predetermined quantity of sewage accumulates in the underground cesspool 4, a vacuum valve 3 provided in the upper portion of the inside of the cesspool 4 is opened so that sewage accumulated in the cesspool 4 is sucked through a suction pipe 11. The sewage sucked through the vacuum valve 3 via suction pipe 11 is introduced into a vacuum sewage pipe 1 arranged underground. Then, it is accumulated in an accumulating tank 10 in a vacuum pump plant 9. The sewage accumulated in the accumulating tank 10 is then sent to a sewage treatment plant or the like by a feeding pump 8.

A vacuum pump 7 is connected to the accumulating tank 10 to create negative pressure in the accumulating tank 10 and the vacuum sewage pipe 1.

FIG. 4 is a side elevational cross-sectional view of the vaccum valve 3 for use in a vacuum-type sewage accumulating apparatus of the type described above.

As shown in the drawing, the vacuum valve 3 is positioned between the vacuum sewage pipe 1 and the suction pipe 11 and is arranged in such a manner that a piston **3*b* thereof is usually pressed by a compression spring 3*d* so that a valve 3*c* integrated with the piston 3*b* is seated on a valve seat 3*e*. Thus, the portion between the vacuum sewage pipe 1 and the suction pipe 11 is closed to prevent sewage in the cesspool 4 from being sucked into the suction pipe 11**.

When the quantity of sewage in the cesspool 4 reaches a predetermined level, it is detected by a sensor (not shown) and a detection signal is supplied to a vacuum valve controller 13. When the vacuum valve controller 13 receives the detection signal, a connecting pipe 2, connected at one end thereof to the controller, and a cylinder chamber **3*a* of the vacuum valve 3 are placed in communication with each other. Since the other end of the connecting pipe 2 is, as illustrated, in communication with the vacuum sewage pipe 1 disposed just downstream of the vacuum valve 3, the pressure in the cylinder chamber 3*a* is set at a negative level. As a result, the piston 3*b* is raised upwards so that the valve 3*c* is lifted from the valve seat 3*e*. Therefore, the vacuum sewage pipe 1 and the suction tube 11** communicate with each other.

Thus, the sewage in the cesspool 4 is, via the suction pipe 11, sucked into the vacuum sewage pipe 1, the pressure of which is at a negative level.

In the above-mentioned system, since a gas-liquid two-phase flow passes through the vacuum sewage pipe 1, the vacuum sewage pipe 1 is not filled with sewage during normal operation.

However, if the gas-liquid ratio is lowered for some reason or the quantity of sewage flowing through the system is considerably less at night, portions in the vacuum sewage pipe 1 arranged toward the vacuum pump plant 9 are filled with sewage, causing a so-called "air lock" to be generated. As a result, the vacuum pressure generated in the vacuum pump plant 9 may be considerably lowered at the peripheral positions of the system due to the several air locks formed in the pipe 1.

However, in the conventional system described above, the vacuum pressure for operating the vacuum valve 3 has been, as described above, taken from the portion of the vacuum sewage pipe 1 just downstream of the vacuum valve 3 which is positioned at substantially the same height as that of the vacuum valve 3. Therefore, if an air lock is formed in the pipe portion just downstream of the vacuum valve 3, the force generated to open the vacuum valve 3 becomes too weak. And, if the valve lifting force is insufficient to overcome the force of the compression spring **3*d*, it is impossible to completely open the valve 3*c***. Therefore, a problem arises in that the discharge of sewage cannot be efficiently performed.

If the valve **3*c*** in insufficiently opened, it easily becomes clogged with waste matter causing the flow of sewage therethrough to be impeded.

SUMMARY OF THE INVENTION

Accordingly, an object of the present invention is to provide a vacuum-type sewage collecting apparatus wherein a vacuum valve is effectively operated with a significantly low negative pressure.

In order to accomplish the above-described object and to supply a significantly low negative pressure to operate a vacuum valve, first embodiment of the present invention is constituted in such a manner that the negative pressure is taken from a vacuum sewage pipe portion elevated at a level higher than that of a pipe portion where the vacuum valve is mounted and it is introduced into the vacuum valve via a connecting pipe.

The second embodiment of the present invention is constituted in such a manner that the negative pressure is taken from an accumulating tank which has been evacuated by a vacuum pump, from a pipe which establishes a connection between the accumulating tank and the vacuum pump, or from a tank connected to the pipe. The thus taken out negative pressure is then introduced into a vacuum valve via a connecting pipe.

In the first embodiment, even if an air-lock is formed in the pipe just downstream of the vacuum valve, a sufficiently low negative pressure may be obtained since the negative pressure is taken from the portion of the vacuum sewage pipe which is elevated above the air-locked portion.

In the second embodiment, since the negative pressure for operating the vacuum valve is directly taken from a negative pressure source, a sufficiently low negative pressure may be obtained without fear of an air lock being formed.

As a result, significantly low negative pressure can be supplied as the force to open and close a vacuum valve irrespective of an air lock or the like. Therefore, the valve mechanism of the vacuum valve can be completely opened, causing the discharge of sewage to be efficiently performed. Furthermore, valve clogging can be prevented.

The above and other objects, features and advantages of the present invention will become more apparent from the following description, when taken in conjunction with the accompanying drawings in which a preferred embodiment of the present invention is shown by way of illustrative examples.

PREFERRED EMBODIMENTS OF THE INVENTION

Next, embodiments of the present invention will be described with reference to the drawings.

Figure 1:
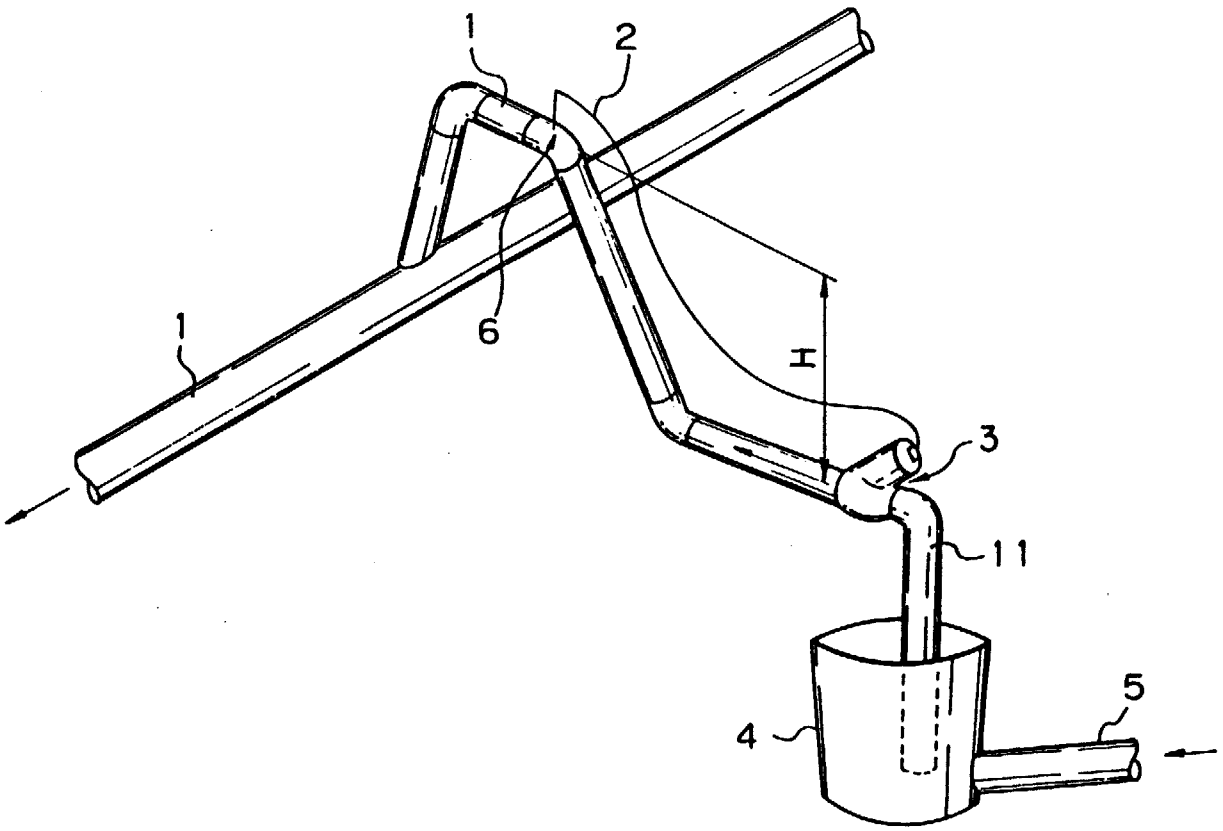
FIG. 1 illustrates structure for taking the negative pressure from the sewage pipe to operate a vacuum valve in a vacuum-type sewage collecting apparatus according to a first embodiment of the present invention.

FIG. 1 illustrates a structure for taking the negative pressure from a sewage pipe to operate a vaccum valve in a vacuum-type sewage collecting apparatus according to a first embodiment of the invention.

According to this embodiment shown in the drawing, as an alternative to taking the negative pressure from the vacuum sewage pipe 1 disposed just downstream of the vacuum valve 3 in the conventional apparatus, a negative pressure taking out portion 6 is provided at the top of an upwardly inclined portion of the vacuum sewage pipe 1, which is disposed at a level higher than that of the vacuum valve downstream from the vacuum valve 3. Furthermore, the negative pressure taking-out portion 6 and the vacuum valve 3 are connected to each other by the connecting pipe 2 so that the negative pressure may be applied to the cylinder chamber of the vacuum valve 3.

As a result of the above-described structure, the negative pressure for operating the vacuum valve 3 is strong enough to completely open the vacuum valve 3 since it has not been lowered due to the formation of an air lock in the vacuum sewage pipe 1 just downstream of the vacuum valve 3.

At this time, if the upwardly inclined portion is filled with sewage and the air lock is formed thereat, the negative pressure at the position just downstream of the vacuum valve 3 has been lowered by a degree corresponding to the water column of height H and measured with respect to the level at which negative pressure taking out portion 6 of the vacuum sewage pipe 1 is disposed.

Figure 2:
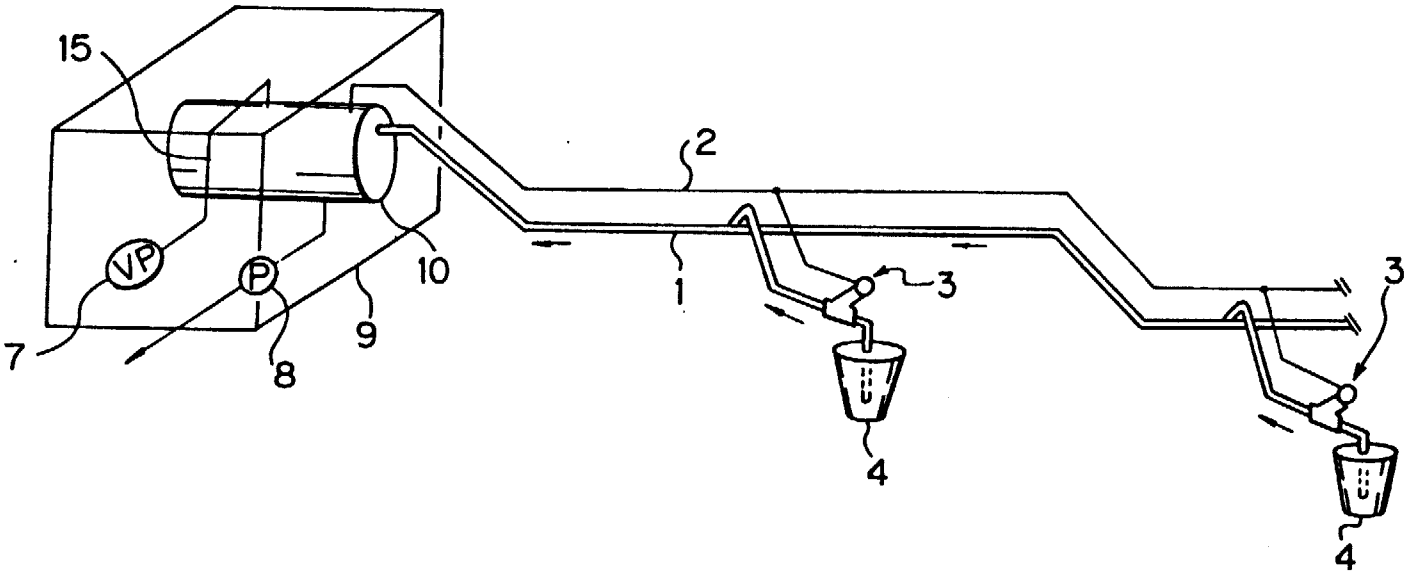
FIG. 2 illustrates structure for taking negative pressure from a connecting pipe to operate a vacuum valve in a vacuum-type sewage collecting apparatus according to a second embodiment of the present invention.
Figure 3:
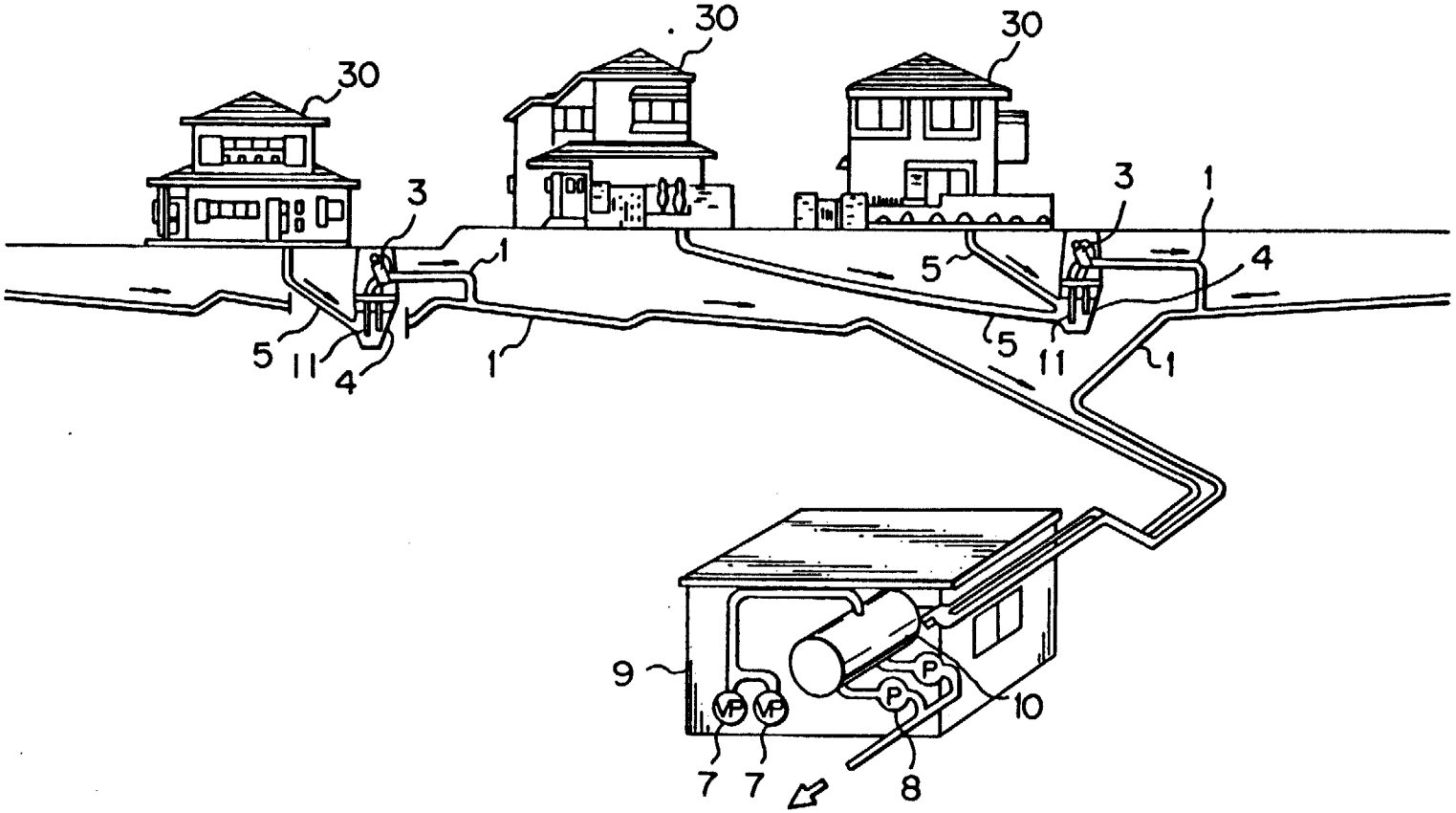
Fig. 3 PRIOR ART
FIG. 3 illustrates the overall structure of the conventional vacuum-type sewage collecting apparatus.
Figure 4:
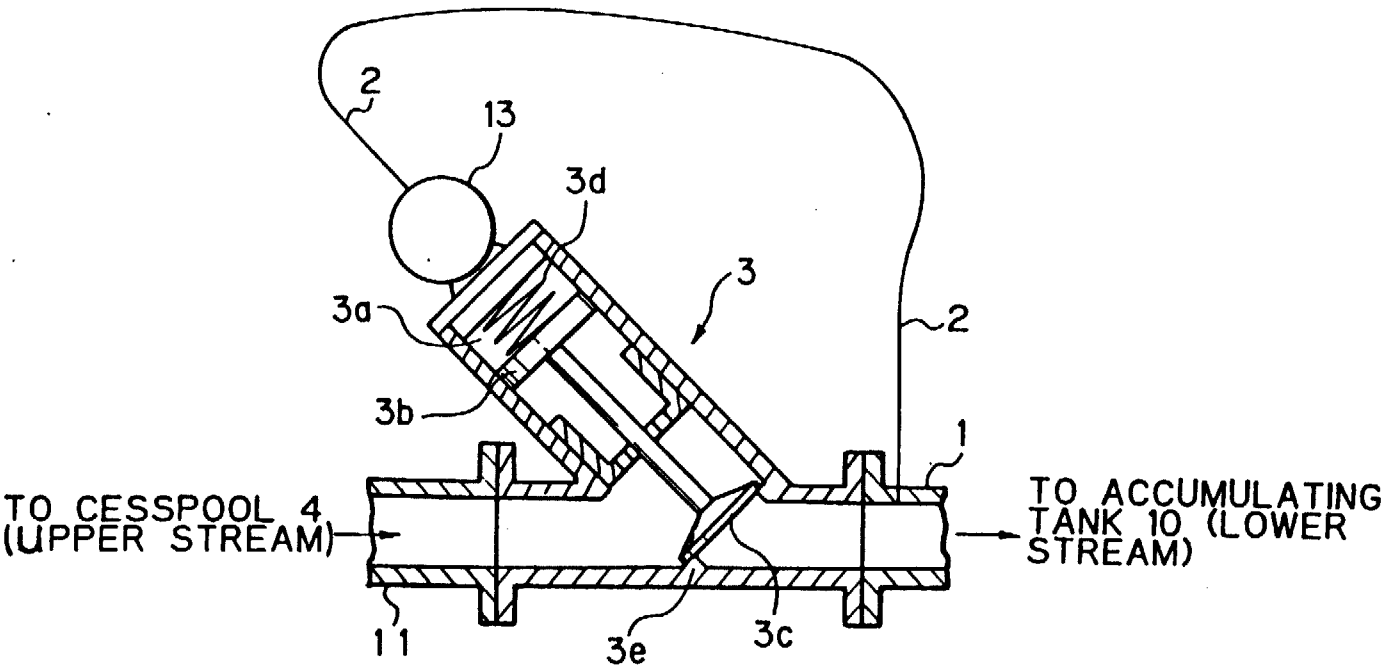
Fig. 4 PRIOR ART
FIG. 4 is a side elevational cross-sectional view of a vacuum valve in the conventional vacuum-type sewage collecting apparatus.

FIG. 2 illustrates a second embodiment of the vacuum-type sewage collecting apparatus.

According to this embodiment, as an alternative to taking the negative pressure from the vacuum sewage pipe 1 disposed downstream of the vacuum valve 3, the accumulating tank 10 and the vacuum valve 3 are connected to each other by the connecting pipe 2 so that the negative pressure is directly taken from the accumulating tank 10 in the vacuum pump plant 9.

As a result of the above-described structure, even if an air lock is generated in the vacuum sewage pipe 1, a significantly low negative pressure in the accumulating tank 10 can be utilized as a force for operating the vacuum valve 3 regardless of the existence of an air lock.

In this embodiment, although the negative pressure for operating the vacuum valve 3 is taken from the accumulating tank 10, the negative pressure may be taken from a pipe 15 which establishes a connection between the accumulating tank 10 and the vacuum pump 7 or it may be taken from a tank (not shown) connected to the pipe 15 so as to introduce the negative pressure into the vacuum valve 3 via the connecting pipe 2.

As described above, according to the vacuum-type sewage collecting apparatus according to the present invention, a high negative pressure can be supplied as a force to operate the vacuum valve in comparison to a conventional structure in which the negative pressure is taken from a vacuum sewage pipe portion just downstream of the vacuum valve. Therefore, the valve can be effectively and completely opened. As a result, the discharge of sewage can be efficiently performed and clogging of the valve can be prevented.

What is claimed is:

1. A vacuum-type sewage collecting apparatus having a cesspool in which sewage discharged from houses or facilities is accumulated, a vacuum valve and a vacuum sewage pipe connected to the cesspool so as to discharge sewage accumulated therein, a collection portion connected to said vacuum sewage pipe so as to collect sewage discharged thereby, a vacuum source for reducing the pressure within the vacuum sewage pipe to a negative pressure, and a connecting pipe connecting the sewage pipe with the vacuum valve such that the vacuum valve is operated by negative pressure taken from the vacuum sewage pipe and supplied to the vacuum valve via the connecting pipe, said vacuum-type sewage collecting apparatus being characterized in that:

a portion of said vacuum sewage pipe is elevated at a level higher than that of said vacuum valve and is disposed downstream of said vacuum valve, said connecting pipe being connected to said vacuum sewage pipe at said portion of the vacuum sewage pipe wherein the negative pressure for operating said vacuum valve is taken from said portion of the vacuum sewage pipe.

2. A vacuum-type sewage collecting apparatus as claimed in claim 1, wherein said vacuum sewage pipe has an upwardly inclined portion downstream of said vacuum valve, said connecting pipe being connected to a top portion of said inclined portion such that said negative pressure for operating said vacuum valve is taken from the top portion of said inclined portion.

3. A vacuum-type sewage collecting apparatus claimed in claim 2, wherein said collection portion comprises an accumulating tank connected to said vacuum sewage pipe, and said vacuum source is a vacuum pump connected to said accumulating tank to create negative pressure in said accumulating tank and said vacuum sewage pipe.

4. A vacuum-type sewage collecting apparatus claimed in claim 2, wherein the apparatus includes a plurality of said cesspools and a respective said vacuum valve and vacuum sewage pipe portion are provided for each cesspool.

5. A vacuum-type sewage collecting apparatus claimed in claim 1, wherein said collection portion comprises an accumulating tank connected to said vacuum sewage pipe, and said vacuum source is a vacuum pump connected to said accumulating tank to create negative pressure in said accumulating tank and said vacuum sewage pipe.

6. A vacuum-type sewage collecting apparatus claimed in claim 1, wherein the apparatus includes a plurality of said cesspools and a respective said vacuum valve and vacuum sewage pipe portion are provided for each cesspool.

7. A vacuum-type sewage collecting aparatus having a cesspool in which sewage discharged from houses or facilities is accumulated, a vacuum valve and a vacuum sewage pipe connected to the cesspool so as to discharge sewage accumulated therein, a collection portion connected to said vacuum sewage pipe so as to collect sewage discharged thereby, a vacuum source for reducing the pressure within the vacuum sewage pipe to a negative pressure, and a connecting pipe connecting the sewage pipe with the vacuum valve such that the vacuum valve is operated by negative pressure taken from the vacuum sewage pipe and supplied to the vacuum valve via the connecting pipe, said vacuum-type sewage collecting apparatus being characterized in that:

said collection portion comprises an accumulating tank and a vacuum pump connected thereto such that the interior of the tank is under negative pressure, and wherein either said accumulating tank, a pipe which establishes a connection between said accumulating tank and said vacuum pump, or a tank connected to said pipe which establishes a connection between said accumulating tank and said vacuum pump is connected directly to said connecting pipe such that said negative pressure is taken directly therefrom to operate said vacuum valve.

8. A vacuum-type sewage collecting apparatus claimed in claim 7, wherein said apparatus includes a plurality of said cesspools, a respective said vacuum valve is provided for each of said cesspools, and each said vacuum valve is supplied with said negative pressure through said connecting pipe.

* * * * *